US008966907B2

(12) United States Patent
Khan et al.

(10) Patent No.: US 8,966,907 B2
(45) Date of Patent: Mar. 3, 2015

(54) TURBINE COMBUSTOR SYSTEM HAVING AERODYNAMIC FEED CAP

(75) Inventors: Abdul Rafey Khan, Greenville, SC (US); Bradley Donald Crawley, Simpsonville, SC (US); Robert Joseph Rohrssen, Greenville, SC (US); Mohan Krishna Bobba, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/448,283

(22) Filed: Apr. 16, 2012

(65) Prior Publication Data

US 2013/0269350 A1 Oct. 17, 2013

(51) Int. Cl.

| | |
|---|---|
| ***F02C 1/00*** | (2006.01) |
| ***F02G 3/00*** | (2006.01) |
| ***F23R 3/28*** | (2006.01) |
| ***F23D 14/64*** | (2006.01) |

(52) U.S. Cl.

CPC ..... *F23R 3/286* (2013.01); *F23D 14/64* (2013.01); *F23D 2209/10* (2013.01); *F23D 2900/14021* (2013.01); *F23D 2900/14701* (2013.01)

USPC ..... 60/737; 60/740; 60/742; 60/746; 60/756

(58) Field of Classification Search

USPC ..... 60/756, 737–748

See application file for complete search history.

(56) References Cited

U.S. PATENT DOCUMENTS

| | | | | |
|---|---|---|---|---|
| 5,339,635 | A * | 8/1994 | Iwai et al. | 60/733 |
| 6,923,002 | B2 | 8/2005 | Crawley et al. | |
| 7,134,287 | B2 | 11/2006 | Belsom et al. | |
| 7,284,378 | B2 | 10/2007 | Amond, III et al. | |
| 7,546,736 | B2 | 6/2009 | Amond, III et al. | |
| 8,123,150 | B2 | 2/2012 | Khan et al. | |
| 8,141,363 | B2 | 3/2012 | Khan et al. | |
| 8,281,596 | B1 * | 10/2012 | Rohrssen et al. | 60/747 |
| 2005/0016177 | A1 * | 1/2005 | Modi et al. | 60/737 |
| 2010/0092896 | A1 | 4/2010 | Barton et al. | |
| 2010/0287942 | A1 | 11/2010 | Zuo et al. | |
| 2011/0083439 | A1 * | 4/2011 | Zuo et al. | 60/737 |
| 2011/0197586 | A1 | 8/2011 | Berry et al. | |
| 2011/0314823 | A1 * | 12/2011 | Smith et al. | 60/737 |

OTHER PUBLICATIONS

Pyronics, "The Way the Venturi and Orifices Work" Mar. 2000 p. 4.*

* cited by examiner

*Primary Examiner* — Phutthiwat Wongwian
*Assistant Examiner* — William Breazeal
(74) *Attorney, Agent, or Firm* — Fletcher Yoder, P.C.

(57) ABSTRACT

Present embodiments are directed toward reducing low flow or no flow situations in a head end of a turbine combustor. Embodiments include a system having a turbine combustor. The turbine combustor includes a fuel nozzle having an inner shell and an outer shell, and a feed cap disposed about the fuel nozzle and having an outer wall and a back plate. The back plate joins respective upstream ends of the outer shell of the fuel nozzle and the outer wall of the feed cap. The turbine combustor is configured to flow a first pressurized air via an air path extending along the outer wall of the feed cap, the back plate of the feed cap, and into the fuel nozzle.

19 Claims, 5 Drawing Sheets

FUEL
AIR
FUEL
AIR
FUEL
COMPRESSOR DISCHARGE
COMPRESSOR
AIR INTAKE
14
12
32
34
50
52
54
56
60
62
64
66
68
70
72
74
76
78
80
82
84
86
88
90
92
94
96
97
98
20
3
5

TURBINE COMBUSTOR SYSTEM HAVING AERODYNAMIC FEED CAP

BACKGROUND OF THE INVENTION

The subject matter disclosed herein relates to turbine combustors, and, more particularly, to a system for creating aerodynamic flow within a turbine combustor head end chamber.

A gas turbine engine combusts a fuel-air mixture in a combustion chamber of a turbine combustor, and then drives one or more turbines with the resulting hot combustion gases. In certain configurations, fuel and air are pre-mixed prior to ignition to reduce emissions and improve combustion. The gas turbine engine mixes the fuel and the air within one or more chambers, such as fuel nozzles. The fuel and air may travel together and/or separately through one or more paths through the turbine combustor. Unfortunately, the one or more paths may include sharp turns, recesses, and other obstructions that create recirculation zones, which may allow the flame holding and/or flashback.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbine combustor having a fuel nozzle with an inner shell and an outer shell and an feed cap disposed about the fuel nozzle having an outer wall and a back plate. The back plate joins respective upstream ends of the outer shell of the fuel nozzle and the outer wall of the feed cap. The turbine combustor is configured to flow a first pressurized air via a first air path extending along the outer wall of the feed cap, the back plate of the feed cap, and into the fuel nozzle.

In a second embodiment, a system includes a turbine combustor having: a combustion chamber, a head end chamber separated from the combustion chamber by a divider plate, and a pressurized chamber disposed in the head end chamber and about a fuel nozzle. The pressurized chamber includes a back plate that is joined to an upstream end of an outer shell of the fuel nozzle.

In a third embodiment, a system includes a turbine combustor having a combustion chamber, a head end chamber separated from the combustion chamber by a divider plate, and an air path disposed in the head end chamber and configured to flow a first pressurized air into a fuel nozzle. The air path includes a first segment disposed between a flow sleeve of the turbine combustor and an outer wall of an feed cap, and a second segment disposed downstream of the first segment and between a back plate of the feed cap and an end plate of the head end chamber. The second segment is substantially free of any flow-impeding surfaces between the back plate and the end plate. The air path also includes a third segment disposed downstream of the second segment and between inner and outer shells of the fuel nozzle.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As noted above, a head end of a gas turbine combustor, which is upstream from a combustion chamber, include areas that are generally not aerodynamic, such as areas that create turbulent flow via one or more sharp turns or edges, areas having low flow conditions where pockets of compressed air and fuel can accumulate, and areas where mixing of fuel and air is undesirable. In other words, the head end of the gas turbine combustor may include recirculation zones, which may include zones in which a mixture of fuel and air has low flow or research relates such that a flame can hold or flash back. Any one or a combination of these conditions can lead to undesirable combustion (e.g., flame holding or flashback) upstream from the combustion chamber of the gas turbine combustor, such as within a head end region or a feed cap region of the gas turbine combustor. The present embodiments include an aerodynamic feed cap design and the head end of the gas turbine combustor to reduce or eliminate recirculation zones. The feed cap may be a one-piece design configured to reduce the possibility forming low-flow regions, no-flow regions, areas of undesired turbulence, recirculation, mixing of fuel and air, and the like. Accordingly, the present embodiments may provide enhanced reliability of gas turbine engines, which in turn may result in more reliable energy production and increased throughput in integrated gasification systems, such as integrated gasification combined cycle (IGCC) systems. Indeed, the present embodiments may be used in any context employing a turbine combustor having areas where low-flow, no-flow, turbulence, and/or recirculation may create undesirable situations (e.g., flashback or flame holding).

Figure 1:
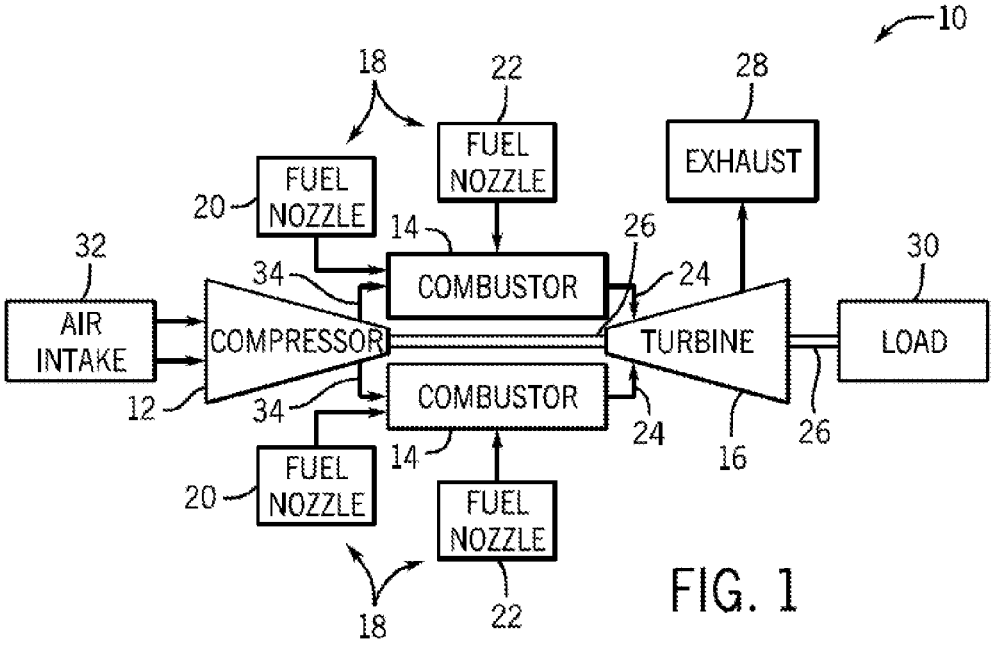
FIG. 1 is a schematic of an embodiment of a gas turbine system with a plurality of turbine combustors, each having a feed cap with a pressurized chamber configured to enable aerodynamic flow into a respective fuel nozzle.

Turning now to the drawings, FIG. 1 illustrates a block diagram of an embodiment of a gas turbine system 10, which may utilize an aerodynamic feed cap in accordance with present embodiments. The system 10 includes a compressor 12, turbine combustors 14, and a turbine 16. The turbine combustors 14 include fuel nozzles 18 which route a liquid fuel and/or gas fuel, such as natural gas or syngas, into the turbine combustors 14. As shown, each turbine combustor 14 may have multiple fuel nozzles 18. More specifically, the turbine combustors 14 may each include a primary fuel injection system having primary fuel nozzles 20 and a secondary fuel injection system having secondary fuel nozzles 22. As described in detail below, each turbine combustor 14 may also include a feed cap configured to reduce undesirable no-flow, low-flow, recirculation, or other undesirable air flow situations. Furthermore, the aerodynamic feed cap of each turbine combustor 14 may mitigate acoustic waves and suppress pressure fluctuations (i.e., reduce the occurrence of dynamics) in the turbine combustor 14. Indeed, such a feed cap design may be desirable to mitigate the possibility of retaining a combustible mixture of fuel and air in a recirculation zone, such as a low velocity region. For example, in a recirculation zone, a flame can hold in this region and/or travel upstream to this region, which may be undesirable.

The turbine combustors 14 ignite and combust an air-fuel mixture, and then pass hot pressurized combustion gasses 24 (e.g., exhaust) into the turbine 16. Turbine blades are coupled to a shaft 26, which is also coupled to several other components throughout the turbine system 10. As the combustion gases 24 pass through the turbine blades in the turbine 16, the turbine 16 is driven into rotation, which causes the shaft 26 to rotate. Eventually, the combustion gases 24 exit the turbine system 10 via an exhaust outlet 28. Further, the shaft 26 may be coupled to a load 30, which is powered via rotation of the shaft 26. For example, the load 30 may be any suitable device that may generate power via the rotational output of the turbine system 10, such as an electrical generator, a propeller of an airplane, and so forth.

Compressor blades are included as components of the compressor 12. The blades within the compressor 12 are coupled to the shaft 26, and will rotate as the shaft 26 is driven to rotate by the turbine 16, as described above. The rotation of the blades within the compressor 12 compress air from an air intake 32 into pressurized air 34. The pressurized air 34 is then fed into the fuel nozzles 18 of the turbine combustors 14. The fuel nozzles 18 mix the pressurized air 34 and fuel to produce a suitable mixture ratio for combustion (e.g., a combustion that causes the fuel to more completely burn) so as not to waste fuel or cause excess emissions. As discussed below, the compressed air may pass through and/or around the feed cap in each combustor 14 upstream from fuel injection.

Figure 2:
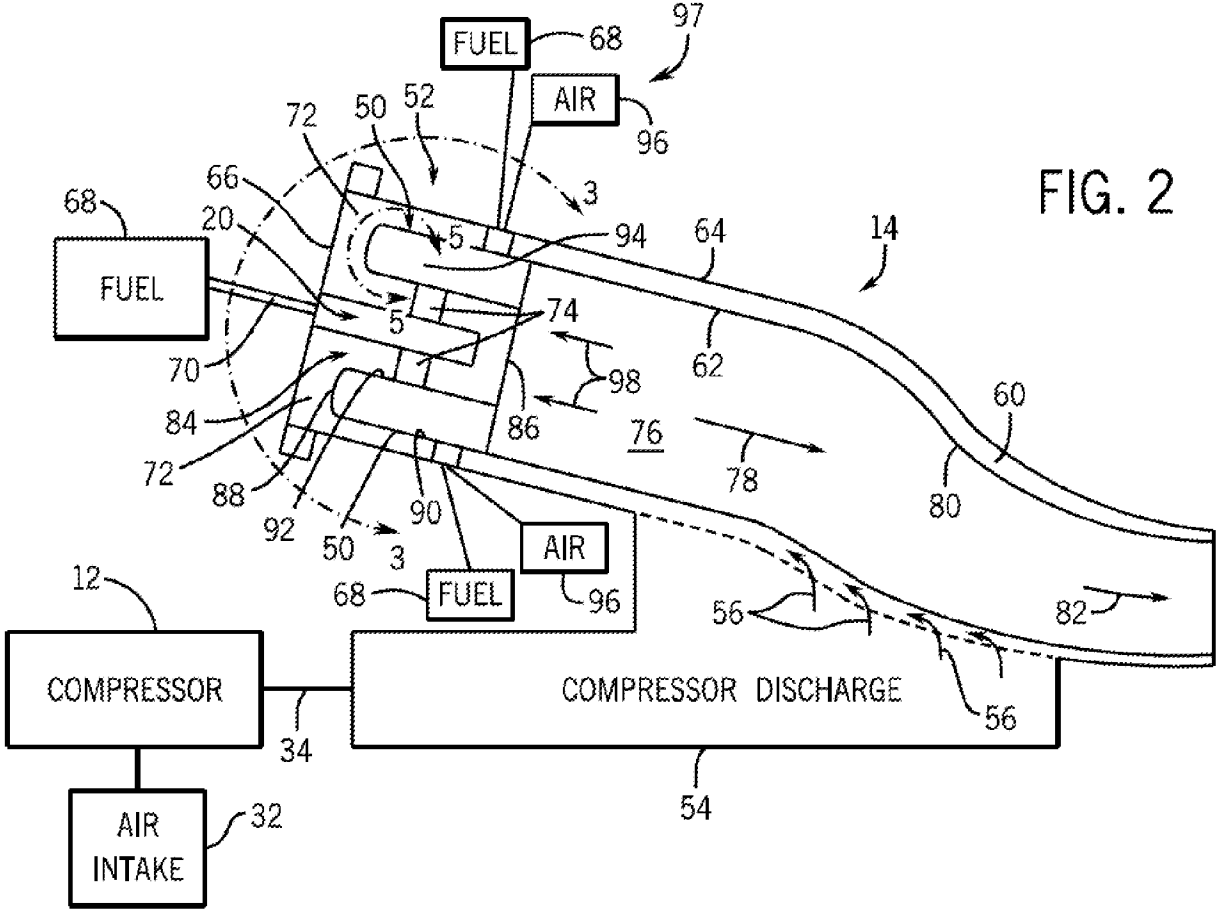
FIG. 2 is a cross-sectional side view schematic of an embodiment of one of the turbine combustors of FIG. 1, illustrating an embodiment of the feed cap with the pressurized chamber having an aerodynamic back plate.

FIG. 2 is a schematic of an embodiment of one of the turbine combustors 14 of FIG. 1, illustrating a feed cap 50 disposed within a head end 52 of the turbine combustor 14 and about a single fuel nozzle 20. As described above, the compressor 12 receives air from the air intake 32, compresses the air, and produces the flow of pressurized air 34 for use in the combustion process within the turbine combustor 14. As shown in the illustrated embodiment, the pressurized air 34 is received by a compressor discharge 54 that is operatively coupled to the turbine combustor 14. As indicated by arrows 56, the pressurized air 34 flows from the compressor discharge 54 toward the head end 52 of the turbine combustor 14. More specifically, the pressurized air 34 flows through an annulus 60 between a liner 62 and a flow sleeve 64 of the turbine combustor 14 to reach the head end 52.

In certain embodiments, the head end 52 includes an end plate 66 that may support the primary fuel nozzles 20 depicted in FIG. 1. In the illustrated embodiment, the head end 52 has the single primary fuel nozzle 20 and associated feed cap 50. However, as discussed below, the head end 52 may include a plurality of fuel nozzles 20, with one or more feed caps 50 surrounding the fuel nozzles 20. In accordance with one embodiment, a single feed cap 50 may surround a plurality of the fuel nozzles 20, such as between 2 and 10 fuel nozzles (e.g., between 2 and 8 or 4 and 6 fuel nozzles).

A fuel supply provides fuel 68 to the primary fuel nozzle 20. Additionally, an air flow path 72 delivers the pressurized air 34 from the annulus 60 of the turbine combustor 14 through the primary fuel nozzle 20. The primary fuel nozzle 20 combines the pressurized air 34 with the fuel 68 provided by the primary fuel supply 68 to form an fuel-air mixture. Specifically, the fuel 68 may be injected into the air flow path 72 by a plurality of swirl vanes 74 and, in some embodiments, additionally by one or more quaternary fuel injectors 97. The fuel-air mixture flows from the air flow path 72 into a combustion chamber 76 where the fuel-air mixture is ignited and combusted to form combustion gases (e.g., exhaust). The combustion gases flow in a direction 78 toward a transition piece 80 of the turbine combustor 14. The combustion gases pass through the transition piece 80, as indicated by arrow 82, toward the turbine 16, where the combustion gases drive the rotation of the blades within the turbine 16.

As noted above, the turbine combustor 14 includes regions where combustion is desired, such as the combustion chamber 76, and regions where combustion is undesirable, such as a head end chamber 84 disposed between the end plate 66 and a divider plate 86 separating the head end 52 from the combustion chamber 76. Combustion (e.g., flashback and/or flame holding) within the head end chamber 84 may be a result of turbulent air flow and fuel-air pockets along the air flow path 72, where the flow recirculates and/or has a low or no velocity in an upstream region, such as upstream of a combustion chamber and/or upstream of a fuel injector (e.g., fuel injector 20), and downstream of quaternary fuel injectors 97. Thus, in accordance with the present disclosure, it is now recognized that these and other undesirable flow conditions may be mitigated, at least in part, by providing an aerodynamic back plate 88 connecting an outer wall 90 of the feed cap 50 with an outer shell 92 of the fuel nozzle 20. Specifically, as discussed in detail below, the back plate 88 connects the outer shell 92 of the fuel nozzle 20 with the outer wall 90 of the feed cap 50 in such a way that the pressurized air 34 is able to flow along the air flow path 72 without encountering substantial turbulence or pockets of low flow or no flow. Further, the configuration of the back plate 88 may also help reduce the occurrence of pressure waves, acoustic waves, and other oscillations referred to as combustion dynamics, produced by the combustion process. Combustion dynamics may cause performance degradation, structural stresses, and mechanical or thermal fatigue in the turbine combustor 14 (e.g., within the head end chamber 84).

The back plate 88, the outer wall 90 of the feed cap 50, the outer shell 92 of the fuel nozzle 20, and the divider plate 86 together define a closed volume or chamber 94. The chamber 94, as illustrated, receives an influx of preconditioned air 96 from the set of quaternary fuel injectors 97 at a pressure that may be equal to or greater than a pressure of the pressurized air 34 flowing along the air path 72. Therefore, relative to the air path 72 and head end chamber 84, the chamber 94 may be considered to be a pressurized chamber. The chamber 94, in some embodiments, receives the preconditioned air 96 at a pressure that is between approximately 1 and 20% higher than the pressure of the pressurized air 34 and/or the air/fuel mixture flowing along the air path 72, such as between approximately 1 and 15%, 1 and 10%, 2 and 8%, 2 and 6%, or 3 and 5% (e.g., approximately 3%, 4%, or 5%) higher. Therefore, the chamber 94 may be sealed to the head end chamber 84, which may prevent an influx of the fuel and/or the air/fuel mixture from entering the chamber 94. In preventing such an influx, the chamber 94 may reduce the likelihood of premature combustion of the air/fuel mixture within the head end chamber 84 as a result of no flow or low flow of the air/fuel mixture. As discussed in further detail below, the chamber 94 may also enable cooling of the divider plate 86 by passing preconditioned air 96 into the combustion chamber 76. The preconditioned air 96 may be the pressurized air 34, or may be from another air source. As discussed below, the quaternary fuel injectors 97 may also inject fuel 86 into the air path 72 to form a fuel-air mixture. Accordingly, the configuration of the back plate 88, and in particular its manner of connection with the outer wall 90 of the feed cap 50 and the outer shell 92 of the fuel nozzle 20, reduces the possibility of flame holding and recirculation of the fuel-air mixture.

Figure 3:
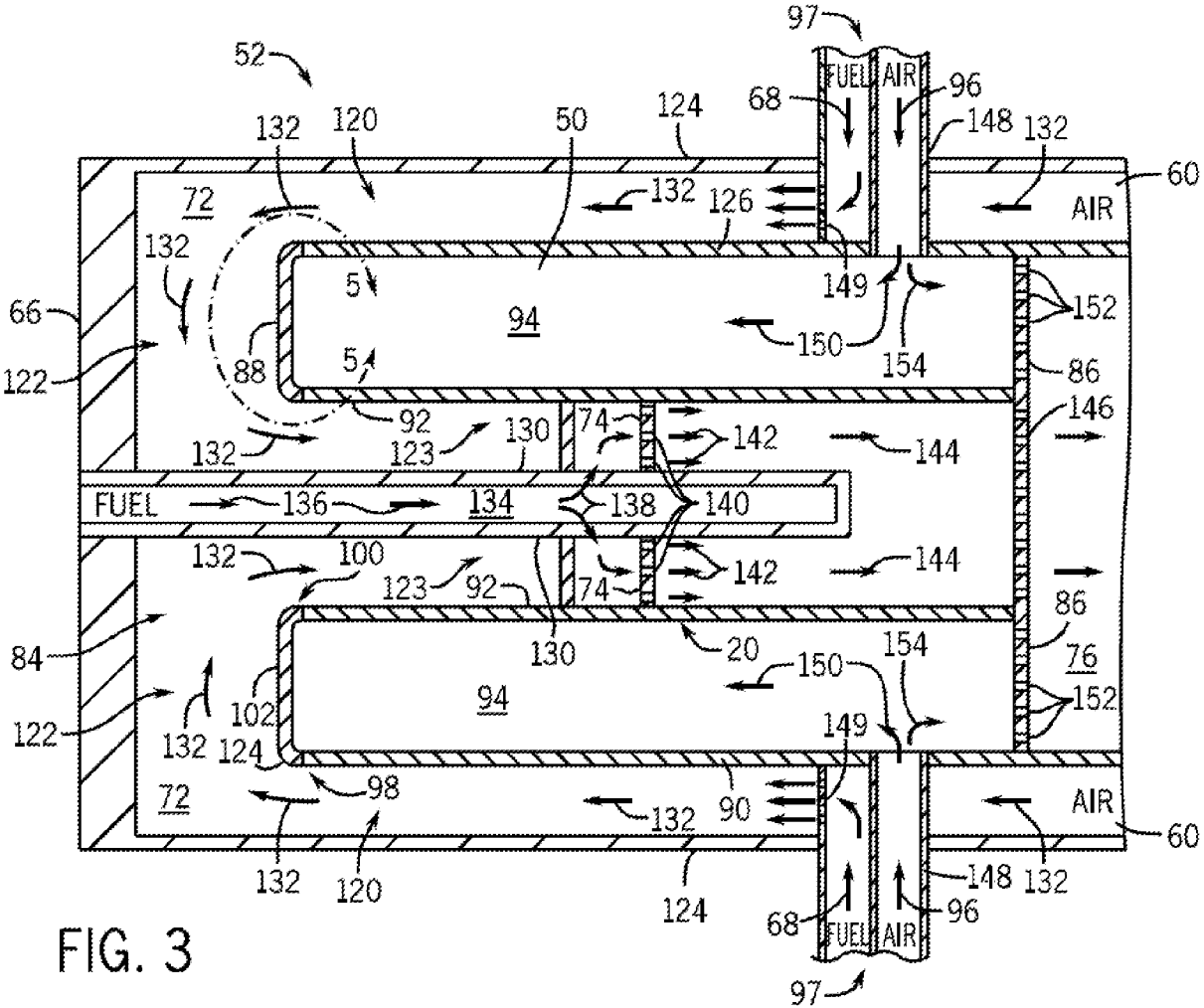
FIG. 3 is a cross-sectional side view schematic of an embodiment of a head end of the turbine combustor of FIG. 2, taken within 3-3, illustrating air flow paths around and through the feed cap and the pressurized chamber.

FIG. 3 is a schematic of an embodiment of the head end 52 of the turbine combustor 14, taken within line 3-3 of FIG. 2, illustrating the chamber 94, the quaternary fuel injectors 97, and the primary fuel nozzle 20 disposed within the head end chamber 84. As noted, the back plate 88 joins the outer wall 90 of the feed cap 50 with the outer shell 92 of the fuel nozzle 20. Specifically, the back plate 88 directly connects a head end terminus 98 of the outer wall 90 with a head end terminus 100 of the outer shell 92. The back plate 88 may take on any aerodynamic form, wherein a main portion 102 of the back plate 88 may be curved (e.g., concave or convex), sinuous, angled, or substantially parallel with respect to the end plate 66 and/or the divider plate 86, as discussed below with respect to FIGS. 5-7. In certain embodiments, the back plate 88 may extend in a substantially straight line from the head end terminus 98 to the head end terminus 100, and may be substantially free of flow-impeding surfaces such as recesses or concave shapes (e.g., with respect to the termini 98, 100). In one embodiment, the back plate 88 is substantially parallel with respect to the end plate 66 and/or the divider plate 86. As defined herein, substantially parallel includes configurations where the entirety of the first portion 102 is oriented to within approximately 2° of parallel with respect to either or both of the end plate 66 and the divider plate 86, accounting for manufacturing tolerances. However, configurations where the main portion 102 is angled with respect to the end plate 66 and/or the divider plate 86 is also presently contemplated, such as angled to between approximately 2 and 30°, 2 and 20°, 2 and 15°, 3 and 10°, or 4 and 8°. As illustrated, the main portion 102 is substantially parallel with respect to both the end plate 66 and the divider plate 86, and is rounded at its first and second edges 104, 106 where it connects to the outer wall 90 and the outer shell 92, respectively. In accordance with present embodiments, the first and second edges 104, 106 may assume any edge configuration, including rounded edges, straight edges, beveled edges, protruding edges, or any edge that does not create shear forces on the pressurized air 34.

Indeed, the configuration of the back plate 88, as discussed herein, facilitates flow of the pressurized air 34 and the fuel-air mixture along the air flow path 72. As mentioned above, the air flow path 72 receives the pressurized air 34 from the annulus 60 of the turbine combustor 14. Additionally, in certain embodiments, the quaternary fuel injectors 97 inject fuel 68 into the flow path 72 to form the fuel-air mixture, which may also flow along the air flow path 72. The air flow path 72 includes a first portion 120, a second portion 122, and a third portion 123. The first portion 120, the second portion 122, and the third portion 123 are operatively coupled. The first portion 120 of the air flow path 72 is defined by an outer wall 124, which may be a head end casing or the flow sleeve 64, and the outer wall 90 of the feed cap 50. The second portion 122 of the air flow path 72 is defined by the end plate 66 of the head end chamber 84 and the back plate 88 of the feed cap 50. The outer shell 92 and an inner shell 130 of the fuel nozzle 20 define the third portion 123. In other words, the flow of the pressurized air 34 and/or the fuel-air mixture flows along an outer surface of the pressurized chamber 94 including a first outer surface of the feed cap 50 disposed around the fuel nozzle 20, an outer surface of the back plate 88, and an outer surface of the outer shell 92 of the fuel nozzle 20. As illustrated, the back plate 88 is disposed at the juncture of the first and second portions 120, 122 and the juncture of the second and third portions 122, 123. In accordance with present embodiments, the shape and positioning of the back plate 88 may facilitate flow of the pressurized air 34 between each portion.

For example, the first edge 104 of the back plate 88, which couples the back plate 88 with the outer wall 90 of the feed cap 50, may be rounded so as to prevent turbulent, recirculating, and/or low-velocity flow as the pressurized air 34 and/or fuel-air mixture flows from the first portion 120 to the second portion 122. Likewise, the second edge 106 of the back plate 88, which couples the back plate 88 with the outer shell 92 of the fuel nozzle 20, may be rounded so as to prevent turbulent, recirculating, and/or low-velocity flow as the pressurized air and/or fuel-air mixture flows from the second portion 122 to the third portion 123. The main portion 102 of the back plate 88 prevents the air and/or fuel-air flow from stalling. In other words, the main portion 102 prevents pockets of pressurized air 34 and/or the air/fuel mixture from becoming trapped in the second portion 122 by enabling continuous flow of the pressurized air 34 and/or the fuel-air mixture. Additionally, the main portion 102 is shaped to prevent areas where a crosswise flow of air is formed in the second portion 122. Generally, the back plate 88 will not have any surfaces that create flow shearing, such as protrusions, obstructions, recesses, and so on. Indeed, the outer wall 90, the back plate 88, and the outer shell 92 are configured such that the air path 72 is substantially free of no flow or low flow regions in which a flow of the pressurized air and/or fuel-air mixture is impeded, halted, or otherwise sheared. That is, the back plate 88 may be a substantially smooth, continuous surface.

As indicated by arrows 132, the pressurized air 34 flows from the annulus 60, first through the first portion 120 of the air flow path 72, through the second portion 122 of the air flow path 72, and then through the third portion 123. As noted, the pressurized air 34 may mix with the fuel 68, forming a fuel-air mixture. Therefore, in the first, second, and third portions 120, 122, 123, the arrows 132 may also represent the fuel-air mixture. The pressurized air 34 and/or fuel-air mixture also flows around the swirl vanes 74. As discussed above, the fuel 68 is released into the pressurized air 34 through the swirl vanes 74. Specifically, the fuel 68 flows down a fuel path 134 within the inner shell 130 of the fuel nozzle 20, as represented by arrows 136. The fuel 68 passes into the swirl vanes 74 from the fuel path 134, as represented by arrows 138, and exits the swirl vanes 74 through fuel ports 140 in the swirl vanes 74, as represented by arrows 142. The fuel 68 mixes with the pressurized air 34 to create an air/fuel mixture. The air/fuel mixture flows downstream, as indicated by arrows 144, toward the combustion chamber 76. In the illustrated embodiment, the divider plate 86 includes one or more openings 146 that operatively join the head end chamber 84 and the combustion chamber 76.

As mentioned above, the head end 52 of the turbine combustor 14 includes the chamber 94, which receives preconditioned air 96. Specifically, the preconditioned air 96 enters the chamber 94 through a preconditioned air inlet 148, while a flow of the fuel 86 enters the first portion 120 of the air flow path 72 through a series of fuel inlets 149. For example, the preconditioned air 96 may be supplied by the compressor discharge 54. While the illustrated embodiment shows two preconditioned air inlets 148, other embodiments may include fewer or more preconditioned air inlets 148. For example, the turbine combustor 14 may have 1, 3, 4, 5, 6, 7, 8, or more preconditioned air inlets 148. The chamber 94 receives preconditioned air 96 from the preconditioned air inlet 148 and fills with the preconditioned air 96, as indicated by arrows 150. Additionally, the preconditioned air 96 may be directed toward apertures 152 in the divider plate 86, as indicated by arrows 154. In certain embodiments, the apertures 152 may be straight or angled holes. The preconditioned air 96 may pass through the apertures 152, thereby cooling the divider plate 86 and entering the combustion chamber 76. As noted, the preconditioned air 96 is provided to the chamber 94 at a pressure sufficient to prevent the influx of the fuel-air mixture produced at the fuel nozzle 20 into the chamber 94. That is, the fuel-air mixture may be at a first pressure, the preconditioned air 96 within the chamber 94 may be at a second pressure, and the second pressure may be greater than the first pressure. Again, the preconditioned air 96 may be between approximately 1 and 15%, 1 and 10%, 2 and 8%, 2 and 6%, or 3 and 5% (e.g., approximately 3%, 4%, or 5%) higher than the pressurized air 34 and/or the fuel-air mixture. Additionally, in certain embodiments, the pressure within the chamber 94 may be at a level sufficient to prevent the influx of the combustion products produced within the combustion chamber 76.

Figure 4:
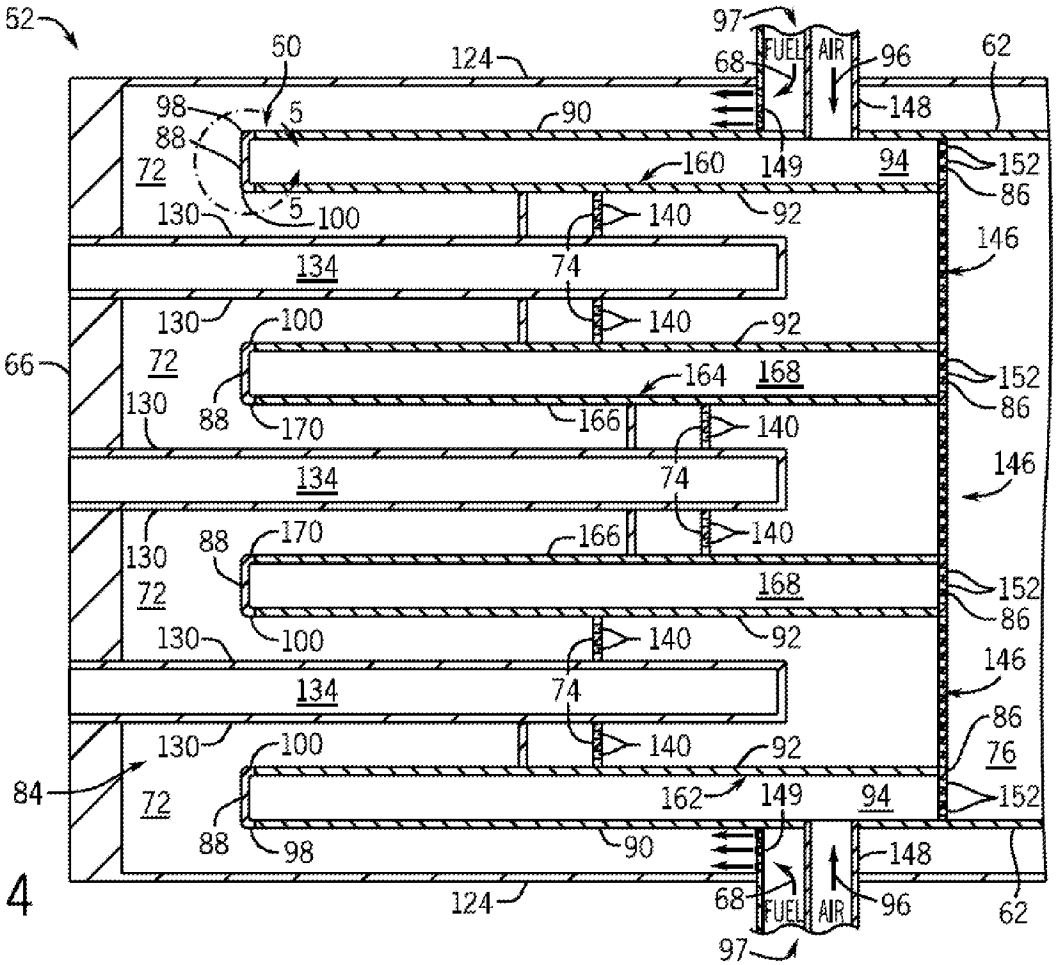
FIG. 4 is a cross-sectional side view schematic of an embodiment of a head end of the turbine combustor of FIG. 2, taken within 3-3, illustrating a plurality of pressurized chambers formed by the feed cap and a plurality of fuel nozzles.

FIG. 4 is a schematic of an embodiment of the head end 52 of the turbine combustor 14, taken along line 3-3 of FIG. 2, illustrating the feed cap 50 disposed about a plurality of fuel nozzles 20. For example, the turbine combustor 14 may include a central fuel nozzle and a plurality of surrounding fuel nozzles (e.g., 2 to 10). In the illustrated embodiment, the feed cap 50 surrounds first and second outer fuel nozzles 160, 162 and a central fuel nozzle 164. In present embodiments, the outer wall 90 of the feed cap 50 acts as a main wall that surrounds all of the fuel nozzles. Additionally, it should be noted that the fuel nozzles 20 are illustrated in a linear configuration to facilitate discussion, and may be in other configurations, such as in an annular arrangement where the fuel nozzles 20 are disposed in a barrel-like configuration. Accordingly, the outer wall 90 of the feed cap 50 is illustrated as only being disposed proximate the first and second outer fuel nozzles 160, 162. Furthermore, the feed cap 50 includes a plurality of openings corresponding to each of the fuel nozzles 160, 162, 164, wherein the respective outer shells 92, 166 of each of the nozzles 160, 162, 164 defines each opening.

As discussed above with respect to FIG. 3, the joining of the outer wall 90 of the feed cap 50 with the outer shell 92 of the fuel nozzle 20 by the back plate 88 and the divider plate 86 forms chamber 94. In a similar manner, the respective outer shells 92 of the first and second outer fuel nozzles 160, 162 and the outer shell 166 of the central fuel nozzle 164 are joined by the back plate 88 and the divider plate 86 to form a volume 168. That is, the back plate 88 of the feed cap 50 joins the head end termini 100 of the outer shells 92 of the first and second outer fuel nozzles 160, 162 with a head end terminus 170 of the outer shell 166 of the central fuel nozzle 164. In this way, the air flow path 72 in the area of the central fuel nozzle 164 may be substantially free of areas of low flow or no flow. Therefore, the illustrated configuration is adapted to reduce the possibility of undesirable flow situations, such as recirculation flow, low-velocity flow, flame holding, and so on, within the head end chamber 84. Additionally, like the chamber 94, the volume 168 may be filled with the preconditioned air 96.

For example, it will be appreciated that the central fuel nozzle 164 is not disposed proximate the outer wall 90 of the feed cap 50. Rather, the first and second outer fuel nozzles 160, 162 are positioned between the first and second central fuel nozzles 164, 166 and the outer wall 90. Thus, the preconditioned air 96 is not directly injected into the volume 168. Instead, the preconditioned air 96 is first directly injected into the chamber 94, and flows toward the central region of the head end 52, which includes the central fuel nozzle 164 and the volume 168. The preconditioned air 96 then fills the volume 168. Thus, the volume 168 and the chamber 94 are in direct flow communication, and may have the same pressure. Indeed, the volume 168 may have a pressure of preconditioned air 96 that is greater than a pressure of an air fuel mixture flowing through the central nozzle 164. For example, the pressure of the preconditioned air 96 within the volume 168 may be between approximately 1 and 15%, 1 and 10%, 2 and 8%, 2 and 6%, or 3 and 5% (e.g., approximately 3%, 4%, or 5%) higher than the pressurized air 34 and/or the fuel-air mixture.

Figure 7:
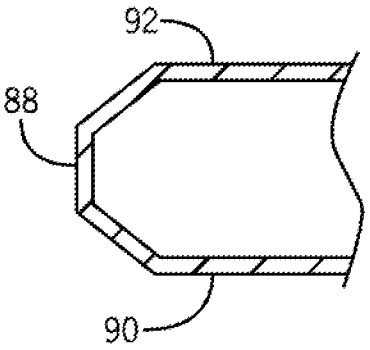
FIG. 7 is a side view of an embodiment of the back plate of FIGS. 3 and 4 in which the back plate is angled generally along a flow direction of the air flow path.
Figure 6:
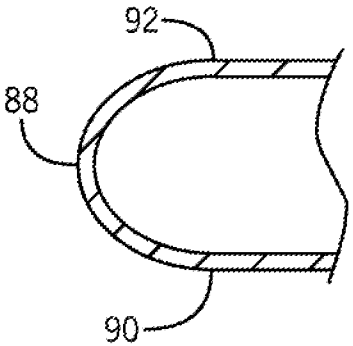
FIG. 6 is a side view of an embodiment of the back plate of FIGS. 3 and 4 having a curved shape that is convex with respect to the head end termini of the outer wall and the outer shell.
Figure 5:
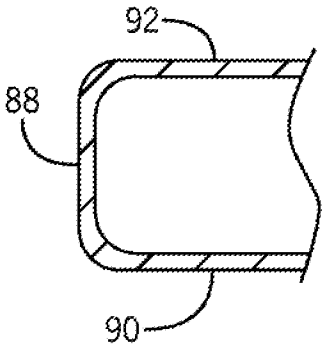
FIG. 5 is a side view of an embodiment of the back plate of FIGS. 3 and 4 having a generally straight shape that is substantially free of any flow-impeding surfaces.

As noted above, the back plate 88 may take on any aerodynamic form that connects the outer wall 90 of the feed cap 50 with the outer shell 92 of the fuel nozzle 20. That is, the back plate 88 is configured to maintain sufficient flow along all boundary surfaces so as to prevent recirculation of the fuel-air mixture and/or the pressurized air 34. Examples of such configurations are illustrated in FIGS. 5-7. Specifically, in FIG. 5, the back plate 88 may have a generally straight shape that is substantially free of any flow-impeding surfaces. Alternatively, the back plate 88 may be bent and/or angled. For example, as illustrated in FIG. 6, the back plate 88 may have a curved shape that is convex (i.e., bows outward) with respect to the head end termini of the outer wall 90 and the outer shell 92. Alternatively or additionally, the back plate 88 may be angled, as illustrated in FIG. 7. In FIG. 7, the back plate 88 is illustrated as being angled generally along a flow direction of the flow path 72. Indeed, any general shape and configuration of the back plate 88 that is configured to reduce the possibility of flame holding, flashback, low-velocity flow, no flow, and similar undesirable flow conditions, are presently contemplated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a turbine combustor, comprising:

a fuel nozzle comprising an inner shell and an outer shell;

a feed cap disposed about the fuel nozzle comprising an outer wall and a back plate, wherein the back plate meets respective upstream end termini of the outer shell of the fuel nozzle and the outer wall of the feed cap; and a pressurized chamber surrounding the fuel nozzle, wherein the outer wall of the feed cap, the outer shell of the fuel nozzle, and the back plate form three walls of the pressurized chamber;

wherein the turbine combustor is configured to flow a first pressurized air from a first source at a first pressure via a fluid path extending along the outer wall of the feed cap, the back plate of the feed cap, and into the fuel nozzle, wherein the fluid path comprises a segment between the back plate of the feed cap and an end plate of a head end chamber of the turbine combustor, wherein the segment is substantially free of flow-impeding surfaces between the back plate and the end plate;

wherein the turbine combustor is configured to flow a second pressurized air from a second source at a second pressure, greater than the first pressure, into the pressurized chamber.

2. The system of claim 1, wherein the back plate of the feed cap is configured to maintain flow along the back plate to impede recirculation of a fluid mixture comprising the first pressurized air and a fuel along the back plate.

3. The system of claim 1, wherein the back plate excludes any obstructions or recesses between the outer shell and the outer wall.

4. The system of claim 1, wherein the turbine combustor comprises a combustion chamber and a divider plate separating the combustion chamber from the head end chamber, wherein the divider plate forms a fourth wall of the pressurized chamber surrounding the fuel nozzle.

5. The system of claim 4, wherein the back plate comprises a flat cross-sectional geometry that is oriented substantially parallel with respect to the end plate of the head end chamber and a rounded cross-sectional geometry at its edges where the back plate merges with the outer wall of the feed cap and the outer shell of the fuel nozzle, and wherein the flat and rounded cross-sectional geometries are along an axial direction of the turbine combustor.

6. The system of claim 4, wherein at least a portion of the fluid path is defined by the inner and outer shells of the fuel nozzle, the end plate of the head end chamber, the back plate of the feed cap, and the outer wall of the feed cap.

7. The system of claim 4, wherein the outer wall of the feed cap and the outer shell of the fuel nozzle are each attached to the divider plate to form the pressurized chamber.

8. The system of claim 7, wherein the turbine combustor is configured to flow only the second pressurized air to the pressurized chamber.

9. The system of claim 1, wherein the turbine combustor comprises a fuel injector along the fluid path upstream from the fuel nozzle and the back plate.

10. The system of claim 1, wherein the turbine combustor comprises a divider plate between a combustion chamber and the head end chamber, wherein the fuel nozzle is disposed in the head end chamber between an end plate and the divider plate, wherein the outer wall of the feed cap, the back plate of the feed cap, and the outer shell of the fuel nozzle are configured to maintain a sufficient flow along all boundaries to impede combustion in the head end chamber.

11. A system, comprising:

a turbine combustor, comprising:

a combustion chamber;

a head end chamber separated from the combustion chamber by a divider plate;

a pressurized chamber disposed in the head end chamber and about a fuel nozzle, wherein the pressurized chamber comprises a back plate that meets an upstream end terminus of an outer shell of the fuel nozzle;

wherein the turbine combustor comprises a first fluid path configured to flow a mixture of fuel and a first pressurized air from a first source at a first pressure along an outer surface of the pressurized chamber, and the outer surface of the pressurized chamber comprises a first outer surface of a feed cap disposed around the fuel nozzle, a second outer surface of the back plate, and a third outer surface of the outer shell of the fuel nozzle; and wherein the turbine combustor comprises a second fluid path configured to flow a second pressurized air from a second source at a second pressure, greater than the first pressure, into the pressurized chamber.

12. The system of claim 11, wherein the turbine combustor comprises the fuel nozzle comprising an inner shell and the outer shell, and the turbine combustor is configured to flow the mixture through the first fluid path along the first outer surface of the feed cap and into the fuel nozzle, and the first fluid path is substantially free of flow impeding surfaces.

13. The system of claim 11, wherein the back plate of the pressurized chamber joins the upstream end terminus of the outer shell of the fuel nozzle and another upstream end terminus of the feed cap disposed about the fuel nozzle.

14. The system of claim 13, wherein the head end chamber comprises an end plate positioned substantially parallel with respect to the divider plate, wherein the back plate comprises a flat wall or a curved wall that is curved toward the end plate.

15. The system of claim 11, wherein the back plate of the feed cap is configured to maintain flow along the back plate to impede recirculation of the mixture along the back plate.

16. A system, comprising:

a turbine combustor, comprising:

a combustion chamber;

a head end chamber separated from the combustion chamber by a divider plate;

a fluid path disposed in the head end chamber and configured to flow a first pressurized air from a first source at a first pressure into a fuel nozzle, wherein the fluid path comprises:

a first segment disposed between a flow sleeve of the turbine combustor and an outer wall of a feed cap;

a second segment disposed downstream of and in fluid communication with the first segment and between a back plate of the feed cap and an end plate of the head end chamber, wherein the back plate meets a head end terminus of the outer wall of the feed cap and the second segment is substantially free of any flow-impeding surfaces between the back plate and the end plate; and a third segment disposed downstream of and in fluid communication with the second segment and between inner and outer shells of the fuel nozzle; and a pressurized chamber formed by the divider plate, the back plate of the feed cap, the outer wall of the feed cap, and the outer shell of the fuel nozzle, wherein the pressurized chamber is configured to receive only a second pressurized air from a second source at a second pressure.

17. The system of claim 16, wherein the fluid path is configured to receive the first pressurized air from an annulus defined by the flow sleeve and a flow liner of the turbine combustor, and wherein the fluid path is configured to mix the first pressurized air with a fuel injected by a quaternary fuel injector to produce a pressurized fuel-air mixture at a third pressure.

18. The system of claim 17, wherein the second pressure is greater than the third pressure.

19. The system of claim 16, wherein the second segment of the fluid path is configured to be substantially free of a crosswise flow of the first pressurized air, wherein the crosswise flow comprises a flow direction oriented crosswise with respect to the end plate of the head end chamber.

* * * * *